US009510629B2

(12) United States Patent
Lause

(10) Patent No.: US 9,510,629 B2
(45) Date of Patent: Dec. 6, 2016

(54) STITCHED GARMENT WITH OPENING INCORPORATED INTO STITCHED PATTERN AND METHOD OF MANUFACTURE

(71) Applicant: Danica Lause, Germantown, WI (US)

(72) Inventor: Danica Lause, Germantown, WI (US)

( * ) Notice: Subject to any disclaimer, the term of this patent is extended or adjusted under 35 U.S.C. 154(b) by 703 days.

(21) Appl. No.: 13/798,597

(22) Filed: Mar. 13, 2013

(65) Prior Publication Data

US 2013/0291285 A1 Nov. 7, 2013

Related U.S. Application Data

(60) Provisional application No. 61/642,114, filed on May 3, 2012.

(51) Int. Cl.
*A41D 27/00* (2006.01)
*A42B 1/22* (2006.01)

(52) U.S. Cl.
CPC ..... *A41D 27/00* (2013.01); *A42B 1/225* (2013.01)

(58) Field of Classification Search
CPC ..... A42B 1/225; D04B 1/24; D04B 1/102; D04B 1/104
See application file for complete search history.

(56) References Cited

U.S. PATENT DOCUMENTS 1,328,545 A * 1/1920 O'Shea ..... A41D 27/10 2/161.1
1,532,750 A * 4/1925 Joha ..... A42B 1/066 2/172
2,910,852 A * 11/1959 Herbert ..... A41B 11/00 66/169 R
3,431,752 A 3/1969 Crawford
5,031,425 A * 7/1991 Cournoyer ..... D04B 1/126 66/196
5,644,799 A * 7/1997 Armenta ..... A42B 1/225 132/273
6,711,749 B2 * 3/2004 White ..... A42B 1/225 2/195.8
6,789,403 B2 * 9/2004 Okamoto ..... D04B 1/246 66/176
7,360,258 B2 4/2008 Jaye et al.
D577,879 S * 10/2008 Jones ..... D2/889
D591,933 S 5/2009 Shirey
D624,286 S 9/2010 Hall
D670,068 S * 11/2012 Bomze ..... D2/889
2003/0135912 A1 * 7/2003 White ..... A42B 1/225 2/195.8
2004/0006809 A1 1/2004 Crenshaw et al.
(Continued)

OTHER PUBLICATIONS

Knitting With Dropped Stitches, by chemknitsblog, www.squdioo.com/knitting-with-dropped-stitches, web site visited on Mar. 4, 2013.

(Continued)

*Primary Examiner* — Richale Quinn
(74) *Attorney, Agent, or Firm* — Andrus Intellectual Property Law, LLP

(57) ABSTRACT

The present disclosure relates to a stitched garment comprising a stitched background, a stitched pattern sewn into the background, and an opening through which an article can be inserted. The opening is integrated into the stitched pattern such that the opening is hidden from view by the stitched pattern.

16 Claims, 10 Drawing Sheets

(56) References Cited

U.S. PATENT DOCUMENTS

| | | | | |
|---|---|---|---|---|
| 2005/0066421 | A1 | 3/2005 | Brundage | |
| 2006/0206984 | A1* | 9/2006 | Jaye | A42B 1/225 2/209.3 |
| 2010/0205715 | A1* | 8/2010 | Dillavou | A42B 1/225 2/69 |
| 2011/0173739 | A1 | 7/2011 | Riesen et al. | |
| 2011/0265247 | A1* | 11/2011 | Nolan | A42B 1/225 2/181 |

OTHER PUBLICATIONS

Knitted Bliss, by Julie Crawford, http://www.knittedbliss.com/2010_10_01_archive.html, web site visited on Mar. 4, 2013.

Knit. Write. Repeat. FO and Free Pattern: XO Cabled Ponytail Hat, by mosshillmama, http://knitwriterepeat.blogspot.com/2011/10/fo-and-free-pattern-xo-cabled-ponytail.html, web site visited on Mar. 11, 2013.

Knitting Scientist: Cabled Ponytail Hat, by lovealegna, http://knittingscientist.blogspot.com/2010/01/cabled-ponytail-hat.html, web site visited on Mar. 11, 2013.

* cited by examiner

STITCHED GARMENT WITH OPENING INCORPORATED INTO STITCHED PATTERN AND METHOD OF MANUFACTURE

CROSS-REFERENCE TO RELATED APPLICATIONS

This application claims priority to and the benefit of U.S. Provisional Application Ser. No. 61/642,114, filed on May 3, 2012, which is hereby incorporated by reference in entirety.

FIELD

The present disclosure relates to garments that are stitched, such as by knitting, crocheting, or weaving. The garment can be a hat, mittens, a scarf, or any other article of wear.

BACKGROUND

Stitched garments can be provided with patterns, such as a cable design or a basket weave pattern. Generally, when such patterns are used to stitch a garment for winter wear, it is not desirable to leave large openings or gaps in the pattern. If an opening or gap is left in the pattern, the opening or gap is generally provided for aesthetic purposes and is purposefully made to be visible, in order to provide an aesthetically interesting look to the stitched garment.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure relates to a stitched garment comprising a stitched background, a stitched pattern sewn into the background, and an opening through which an article can be inserted. The opening is integrated into the stitched pattern such that the opening is hidden from view by the stitched pattern.

The present disclosure also relates to a method of making a ponytail hat. The method comprises stitching a plurality of rows of stitches to create a stitched background. The method further comprises stitching a cable into the stitched background. The method further comprises stitching an opening for a wearer's ponytail into the cable. The opening is integrated into the cable such that the opening is hidden from view.

DETAILED DESCRIPTION OF THE DRAWINGS

In the present description, certain terms have been used for brevity, clearness and understanding. No unnecessary limitations are to be implied therefrom beyond the requirement of the prior art because such terms are used for descriptive purposes only and are intended to be broadly construed. The different articles and methods described herein may be used alone or in combination with other articles and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Figure 1:
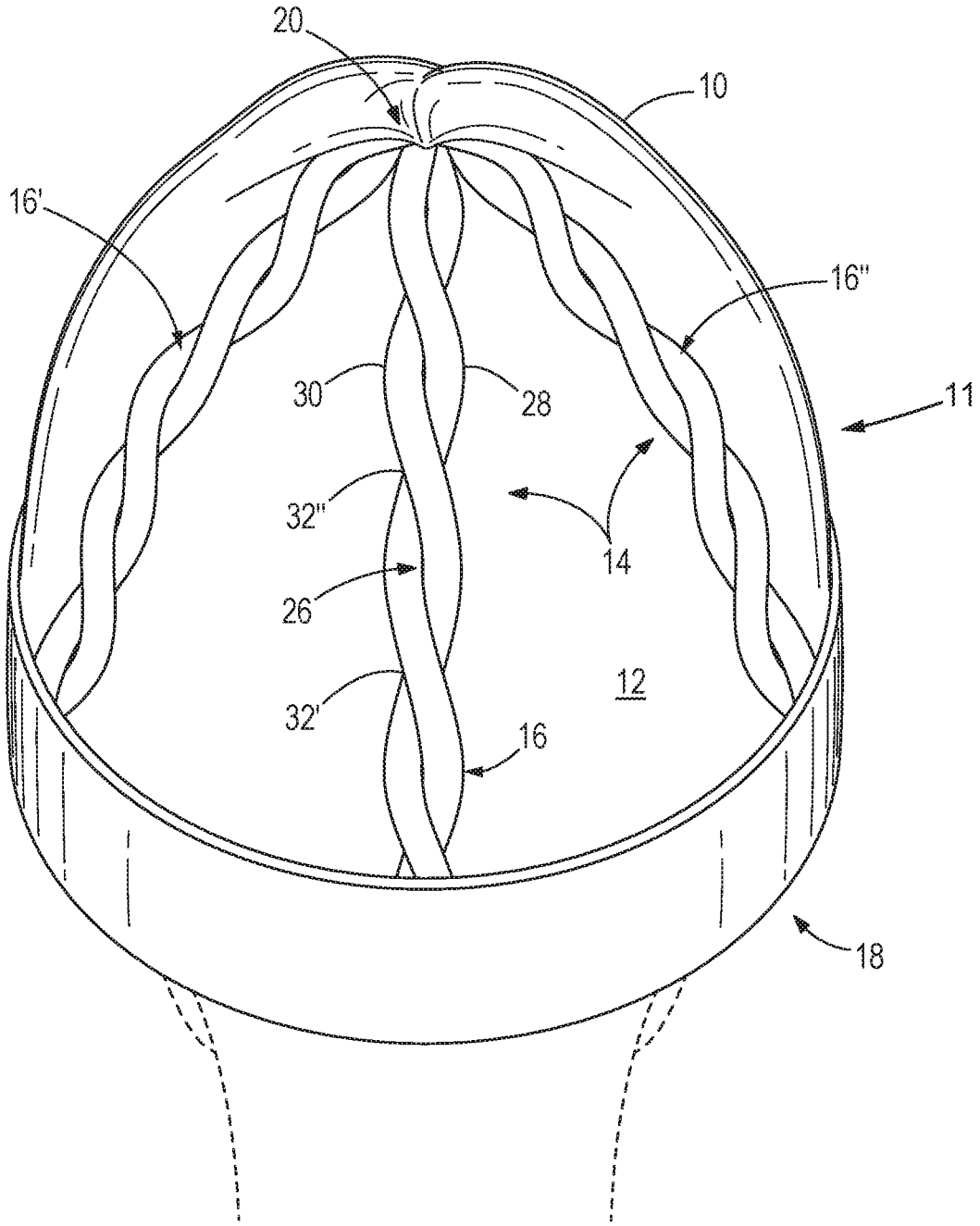
FIG. 1 illustrates one example of a stitched garment according to the present disclosure.

FIG. 1 illustrates a stitched garment according to the present disclosure. In the example of FIG. 1, the stitched garment is a hat 10. The hat 10 can be stitched according to any known method, such as knitting, crocheting, and/or weaving. In the event that the hat 10 is knitted, the hat 10 can be knitted according to any known method, such as by hand or by machine. Additionally, the hat 10 could be knitted as a flat garment or could be knitted in the round.

The hat 10 comprises a main body 11 of knit or crocheted yarn or strips of fabric, and includes a stitched background 12 comprising a plurality of interlocking loops of the yarn or strips of fabric. A stitched pattern 14 is integrated into the stitched background 12 such that it comprises part of the background 12. In the example shown, the stitched pattern 14 comprises one or more cables 16. Each cable 16 is a pattern that is integrally formed with the knit or crocheted yarn or strips of fabric. In the example shown, the hat 10 comprises three cables 16, 16', and 16". However, it should be understood that the hat 10 could comprise fewer or more cables 16. The hat 10 comprises a brim 18 and a crown 20.

Figure 2:
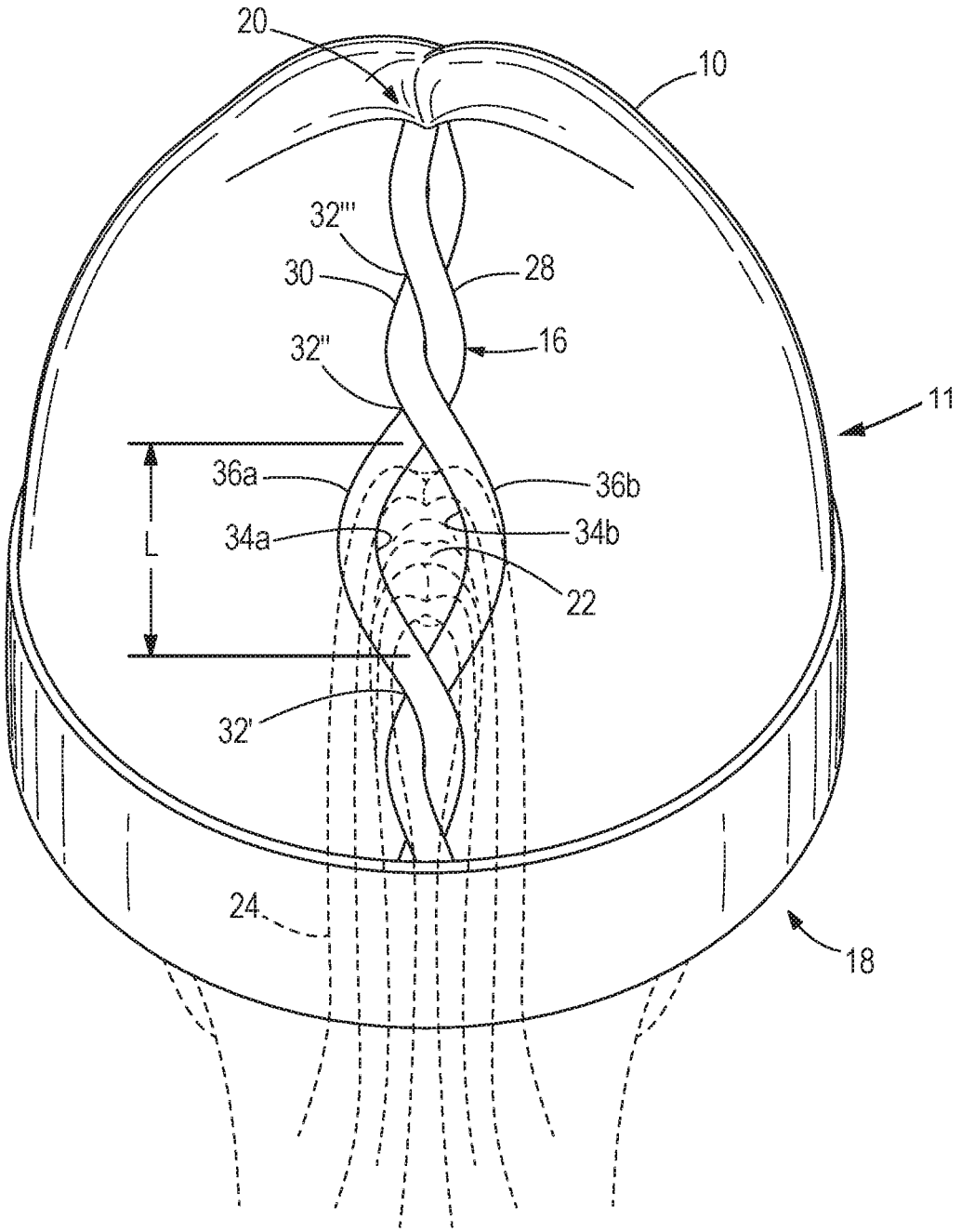
FIG. 2 illustrates the stitched garment of FIG. 1, with an article inserted through an opening in the stitched garment.

Turning to FIG. 2, the hat 10 comprises an opening 22 through which an article can be inserted. In the example shown in FIG. 2, the article is a wearer's hair 24. By comparison between FIGS. 1 and 2, it can be seen that when the wearer's hair 24 is inserted through the opening 22, the opening 22 is wider than when the wearer's hair 24 is not inserted through the opening 22. For instance, in FIG. 1, the opening 22 is provided where indicated by arrow 26, yet the opening 22 is hidden from view by the stitched pattern 14. In FIG. 1, the opening 22 is therefore in an un-stretched state in which it is hidden from view. The opening 22 is not visible in FIG. 1, as indicated by arrow 26, because it is integrated into the stitched pattern 14. In contrast, in FIG. 2, the opening 22 has been manipulated by stretching such that the opening 22 is wide enough to pull the wearer's hair 24 through. It should be understood that by describing the opening 22 as being "hidden from view" or "not visible", the present disclosure and appended claims are not meant to exclude openings that are somewhat or barely visible. Rather, the present disclosure and appended claims are meant to cover openings that are substantially hidden from view (even if somewhat visible under certain circumstances) as opposed to openings that are intentionally knitted as wide gaps for aesthetic purposes.

With continued reference to FIGS. 1 and 2, the cable 16 comprises a first strand 28 and a second strand 30. The opening 22 is located between the first strand 28 and the second strand 30. The first strand 28 and the second strand 30 each comprise inner edges 34*a*, 34*b* adjacent the opening 22 and outer edges 36*a*, 36*b* sewn to the background 12. The opening 22 is therefore located between the inner edge 34*a* of the first strand 28 and the inner edge 34*b* of the second strand 30. In the example shown, the opening 22 has a length L.

The cable 16 also comprises at least one turning row 32, described more fully herein below, where one of the first strand 28 and the second strand 30 is crossed over the other of the first strand 28 and the second strand 30. In fact, the cable 16 comprises multiple turning rows 32', 32", and 32'", as shown in FIGS. 1 and 2. In the example shown, the opening 22 is located between two turning rows 32' and 32". It should be understood that the opening 22 can be provided between any two turning rows, such as turning rows 32" and 32'". Further, it should be understood that more than one opening 22 can be provided within each cable 16. Further, it should be understood that an opening 22 can be provided in any or all cables on the hat 10, such as cable 16' and/or cable 16". In the examples shown, the first strand 28 is crossed over the second strand 30, but the crossing could be reversed. Additionally, the crossing could alternate within one cable 16, such that at one turning row 32' the first strand 28 is crossed over the second strand 30, and at another turning row 32" the second strand 30 is crossed over the first strand 28.

Figure 3:
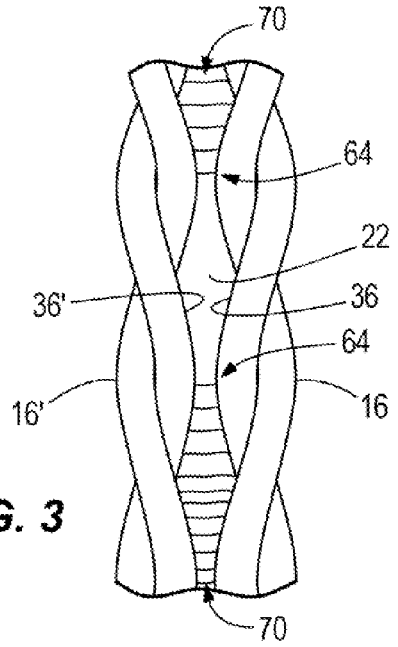
FIG. 3 illustrates another example of an opening in a stitched garment.

As shown in FIG. 3, in another example, the opening 22 could be provided between two cables 16, 16' in a double cable pattern, otherwise known as an arrow cable. For example, the opening 22 can be provided between the points 64 where stitches are twisted to meet, and then reversed in direction to separate, between two individual cables 16, 16' that are combined to form the double cable. In the example shown, the opening 22 is formed between the outer edges 36, 36' of the strands of the two cables 16 and 16'. Normally when stitching an arrow cable, the outer edges 36, 36' of the strands are stitched together, as shown by arrows 70. The opening 22 in the example of FIG. 3 is therefore formed by not stitching together the outer edges 36, 36' of the strands between the points 64, as opposed to what is normally done when stitching an arrow cable. In other words, the stitched pattern 14 comprises two cable units 16, 16' that are stitched side-by-side to form an arrow cable, and the opening 22 is provided between the two cable units 16, 16'.

Figure 4:
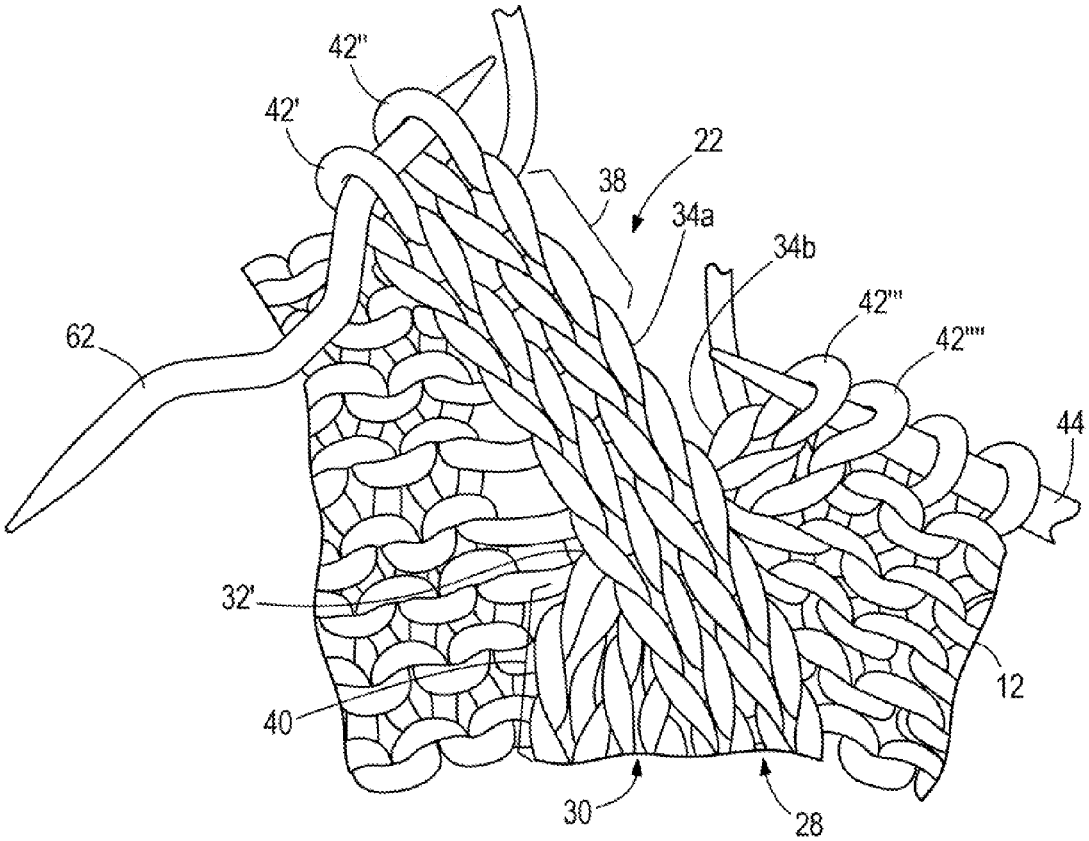
FIG. 4 illustrates a portion of another example of an opening in a stitched garment.

Now with reference to FIG. 4, the opening 22 will be further described. FIG. 4 illustrates a portion of the first and second strands 28, 30 that are near the turning row 32', i.e., immediately before and after the first strand 28 has been crossed over the second strand 30 and stitched to the second strand 30. FIG. 4 therefore shows a lower portion of the opening 22. In the example illustrated, the first strand 28 of the cable 16 has a first plurality of rows of interlocking loops 38 and the second strand 30 has a second plurality of rows of interlocking loops 40. The turning row 32' is also illustrated in more detail in FIG. 4. In FIG. 4, the first strand 28 is crossed over the second strand 30 at the turning row 32'. In other words, the above-noted pattern comprises a first plurality of rows of interlocking loops 38 that crosses over a second plurality of rows of interlocking loops 40. The inner edges 34*a*, 34*b* of the first and second strands 28, 30, respectively, are also shown in more detail in FIG. 4. Each of the first and second strands 28, 30 comprises multiple interlocking loops 42 in each of the first 38 and second 40 pluralities of rows of interlocking loops. For example, as shown in FIG. 4, the first strand 28 comprises two loops 42', 42" per row of interlocking loops. The second strand 30 also comprises two loops 42'", 42"" per row of interlocking loops.

As described herein above, when the opening 22 does not have a wearer's hair inserted through it, the opening 22 is hidden from view by the stitched pattern 14, in this example, by the twisting (or crossing) of the first and second strands 28, 30 of the cable 16. The opening 22 can be hidden from view by stitching the cable 16 in several different ways, as described herein below.

Figure 5:
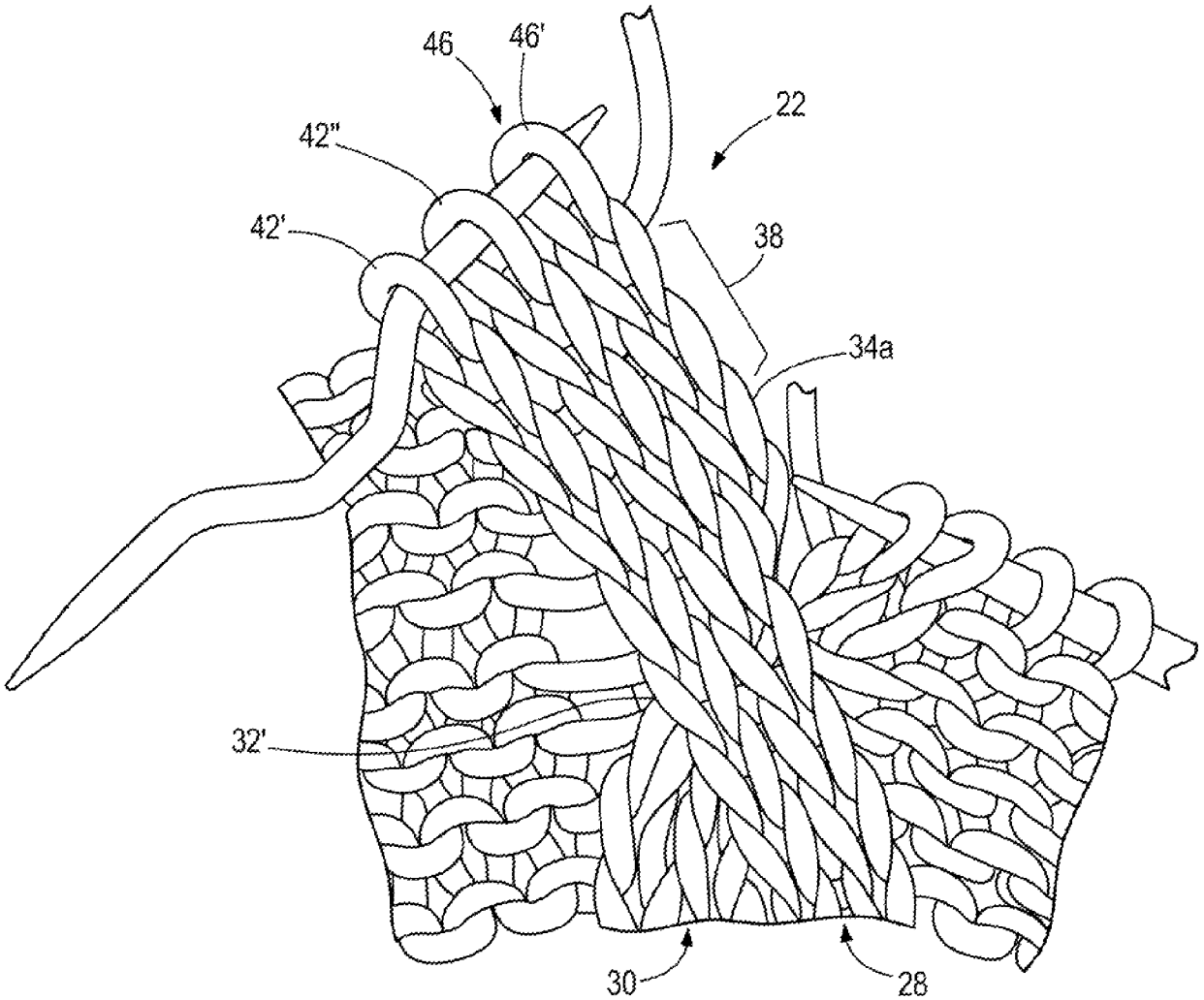
FIG. 5 illustrates a portion of another example of an opening in a stitched garment.

In one example, with reference to FIG. 5, extra interlocking loops, as shown at 46, can be added to at least the first plurality of rows of interlocking loops 38 at the inner edge 34*a* of the first strand 28. The extra interlocking loops 46 are stitched such that each row in the first plurality of rows of interlocking loops 38 comprises three loops 42', 42", and 46'. In the example shown the extra loops 46 are added only after the turning row 32' has been completed. In other words, the first strand 28 only comprises two loops 42', 42" before the turning row 32', but then comprises three loops per row 42', 42", 46' after the turning row 32'. The extra loops 46 continue for the entire length L of the opening 22 until the turning row 32", where the number of loops per row returns to two. Extra interlocking loops could be added to the second plurality 40 of rows of interlocking loops at the inner edge 34*b* of the second strand 30 as well, although this is not shown herein. The extra interlocking loops 46 fill the opening 22 and hide the opening 22 from view. However, the extra interlocking loops 46 are not interlocked with the loops in the second strand 30 of the cable 16, so as to leave the opening 22 between the first and second strands 28, 30. With reference to the arrow cable of FIG. 3, the same principle of adding extra stiches applies; however, extra stitches are added to the outer edges 36, 36' of the strands in order to fill the opening 22 and hide it from view.

In another example, with reference back to FIG. 4, each of the first and second strands 28, 30 can comprise multiple interlocking loops per row that add density to the first and second strands 28, 30 and hide the opening 22 from view. For example, as shown in FIG. 4, the first strand 28 comprises two loops 42', 42" per row. The second strand 30 also comprises two loops 42'", 42"". As opposed to a cable 16 that only comprises one loop per row in each of the strands 28, 30, having multiple loops per row adds density and bulk to the cable and hides the opening 22 from view. It can therefore be understood that stitching three, four, or more loops per row in each strand 28, 30 would provide even more density and bulk to hide the opening 22. Using multiple loops per row differs from adding loops to the inner edge 34*a* and/or 34*b* of a strand 28 or 30 in that in the latter example, the cable 16 comprises more interlocking loops only in the opening 22 rather than along the entire strand 28 and/or 30. However, adding density by providing multiple interlocking loops per row can be used alone or in combination with adding extra interlocking loops 46 on the inner edges 34*a*, 34*b* of either or both of the first and second strands 28, 30 to hide the opening 22 from view (see FIG. 5).

Figure 6:
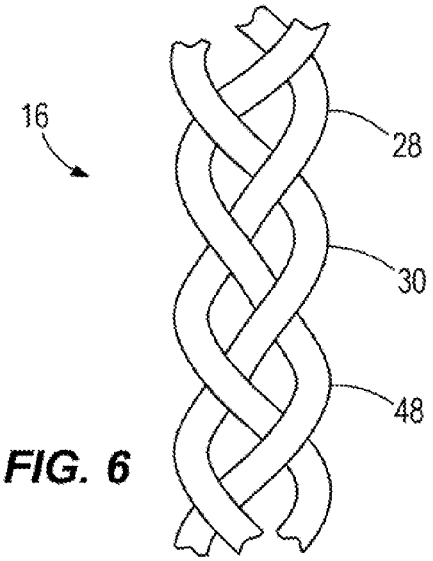
FIG. 6 illustrates another example of a cable for a stitched garment.

In another example, as shown in FIG. 6, a third strand 48 could be crossed with the first and second strands 28, 30 to provide density to the cable 16 and hide the opening 22 from view. For example, the third strand 48 could be braided with the first and second strands 28, 30. It should be understood that providing even more strands (four, five, etc.) would add further bulk to the cable 16 and further hide the opening from view. Providing a third strand 48 can be used alone or in combination with providing multiple interlocking loops per row and/or adding extra interlocking loops 46 on the inner edges 34*a*, 34*b* of either or both of the first and second strands 28, 30 to hide the opening 22 from view.

If a full row of interlocking loops is sewn immediately after forming the turning row 32', this will force the opening 22 to remain open. Conversely, if no full row interlocking loops is provided immediately after the turning row 32', this will pull the opening 22 together at the turning row 32'. In other words, with further reference to FIG. 4, to further hide the opening 22 from view, the first plurality of rows of interlocking loops 38 can stop at the inner edge 34*a* of the first strand 28 and the second plurality of rows of interlocking loops 40 can stop at the inner edge 34*b* of the second strand 30. If the first plurality of rows of interlocking loops 38 is then sewn to the second plurality of rows of interlocking loops 40 in a turning row 32', the opening 22 will be forced closed at that turning row 32'. This is opposed to forming a row of interlocking loops after the turning row 32' that crosses through opening 22. It should be noted that it is not necessary to omit a row of interlocking loops immediately after the turning row 32' in order to hide the opening 22 from view, as the other examples provided herein above and below could be used to hide the opening from view even if a full row of interlocking loops is sewn after forming the turning row 32'.

Figure 7:
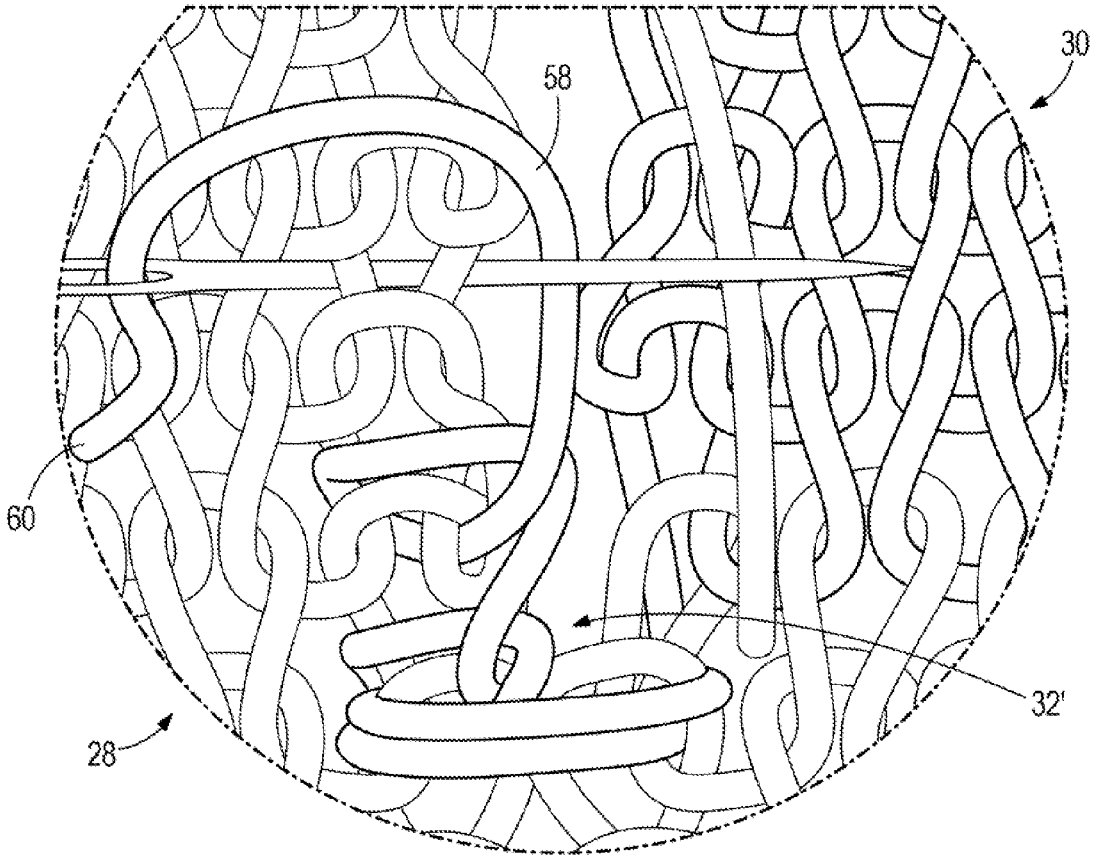
FIG. 7 illustrates a detailed view of a portion of another example of an opening in a stitched garment.

Further, the interlocking loops near the turning row 32' can be reinforced with extra yarn 58, as shown in FIG. 7. For example, extra yarn 58 that is used to stitch the second strand 30 of the cable 16 (described further herein below) can be doubled around the stitches in the turning row 32' and the loose end 60 of the extra yarn 58 can be sewn into the first strand 28 of the cable 16. The extra yarn 58 may not only reinforce the interlocking loops at the turning row 32', but may also pull the first and second strands 28, 30 more together, thereby pulling the opening 22 more together, and thereby hiding the opening 22 from view.

Either or both of stopping stitches at the inner edges 34*a*, 34*b* of the first and second strands 28, 30 and/or reinforcing the opening 22 with extra yarn 58 can be provided in combination with any of crossing a third strand 48 with the first and second strands 28, 30, providing multiple interlocking loops per row, and adding extra interlocking loops 46 on the inner edges 34*a*, 34*b* of either or both of the first and second strands 28, 30. In fact, all of these can be used in combination to hide the opening 22 from view. Additionally or in the alternative, the gauge of the interlocking loops in the first strand 28 and the second strand 30 can be manipulated so as to create a bunching effect and hide the opening 22 from view. In one example, the interlocking loops in the first and second plurality of rows of interlocking loops 38, 40 can be loosely knit where they are attached to the background 12 and can become increasingly more tightly knit as the inner edges 34*a*, 34*b* of the respective first and second strands 28, 30 are approached. In another example, each of the stitches in the first and second plurality of rows of interlocking loops 38, 40 can be knit with the same gauge, and only the innermost stitches (at the inner edges 34*a*, 34*b*) can be tightly knit. If the innermost stitches at the inner edges 34*a*, 34*b* are more tightly knit, this will pull the interlocking loops together at the opening 22 and cause the above mentioned bunching effect.

Additionally, any of the above mentioned examples for hiding the opening 22 from view can be utilized with the arrow cable pattern shown in FIG. 3.

Figure 8:
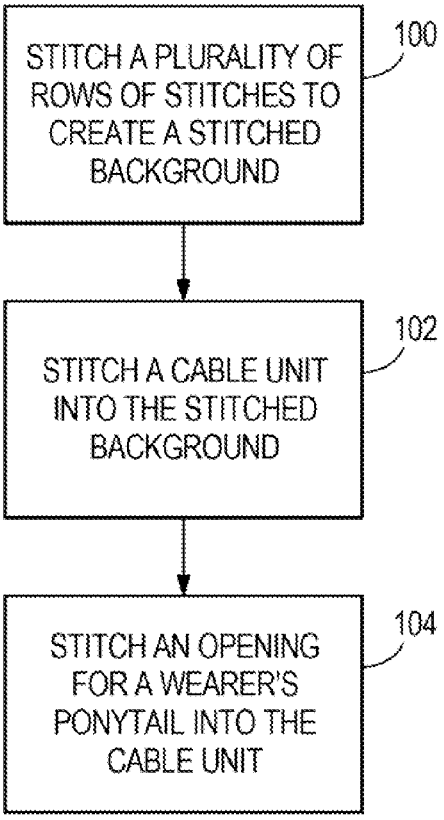
FIG. 8 illustrates a method of stitching a stitched garment.

Now with reference to both FIG. 4 and FIG. 8, a method of making a ponytail hat will be described. As shown at 100, the method comprises stitching a plurality of rows of stitches to create a stitched background 12. As shown at 102, the method further comprises stitching a cable 16 into the stitched background 12. As shown at 104, the method further comprises stitching an opening 22 for a wearer's hair 24 into the cable 16. The opening 22 is stitched according to the method of FIG. 9.

Figure 9:
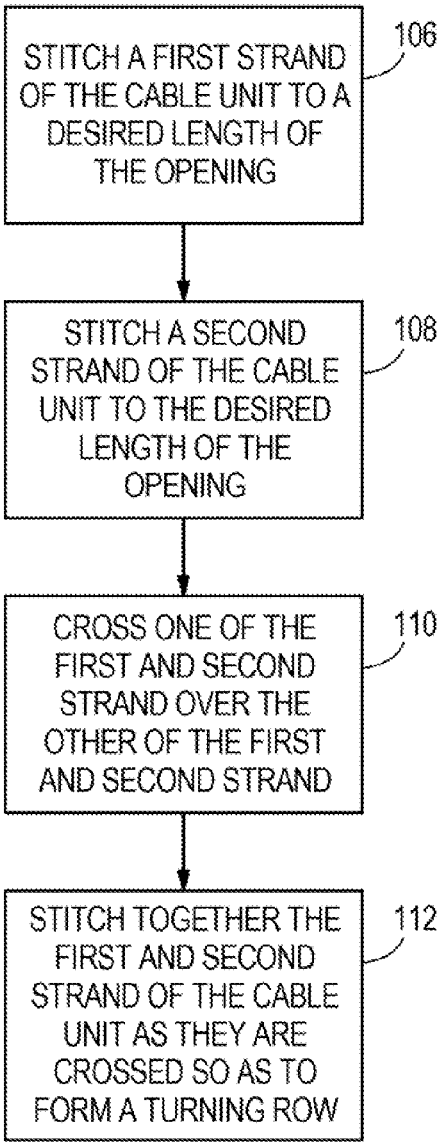
FIG. 9 illustrates a further method of stitching a stitched garment.

In FIG. 9, as shown at 106, the method for stitching the opening includes stitching a first strand 28 of the cable 16 to a desired length of the opening 22. For example, the desired length can be the length L shown in FIG. 2. As shown at 108, the method further comprises stitching a second strand 30 of the cable 16 to the desired length L of the opening 22. As shown at 110, the method further comprises crossing one of the first 28 and second 30 strands over the other of the first 28 and second 30 strands. As shown at 112, the method further comprises stitching together the first 28 and second 30 strands of the cable 16 as they are crossed so as to form a turning row 32.

When the ponytail hat is knitted as a flat garment, the first strand 28 of the cable 16 is stitched to the desired length L of the opening 22 prior to stitching the second strand 30 to the desired length L of the opening 22. When the ponytail hat is knitted in the round, the plurality of rows of stitches are worked around in a back and forth manner, and each of the first strand 28 and the second strand 30 has stitches added to it in an alternating fashion. Therefore, the steps as shown at 106 and 108 of FIG. 9 need not be performed in the sequence shown, but could be performed at the same time or in an alternating fashion.

Figure 10:
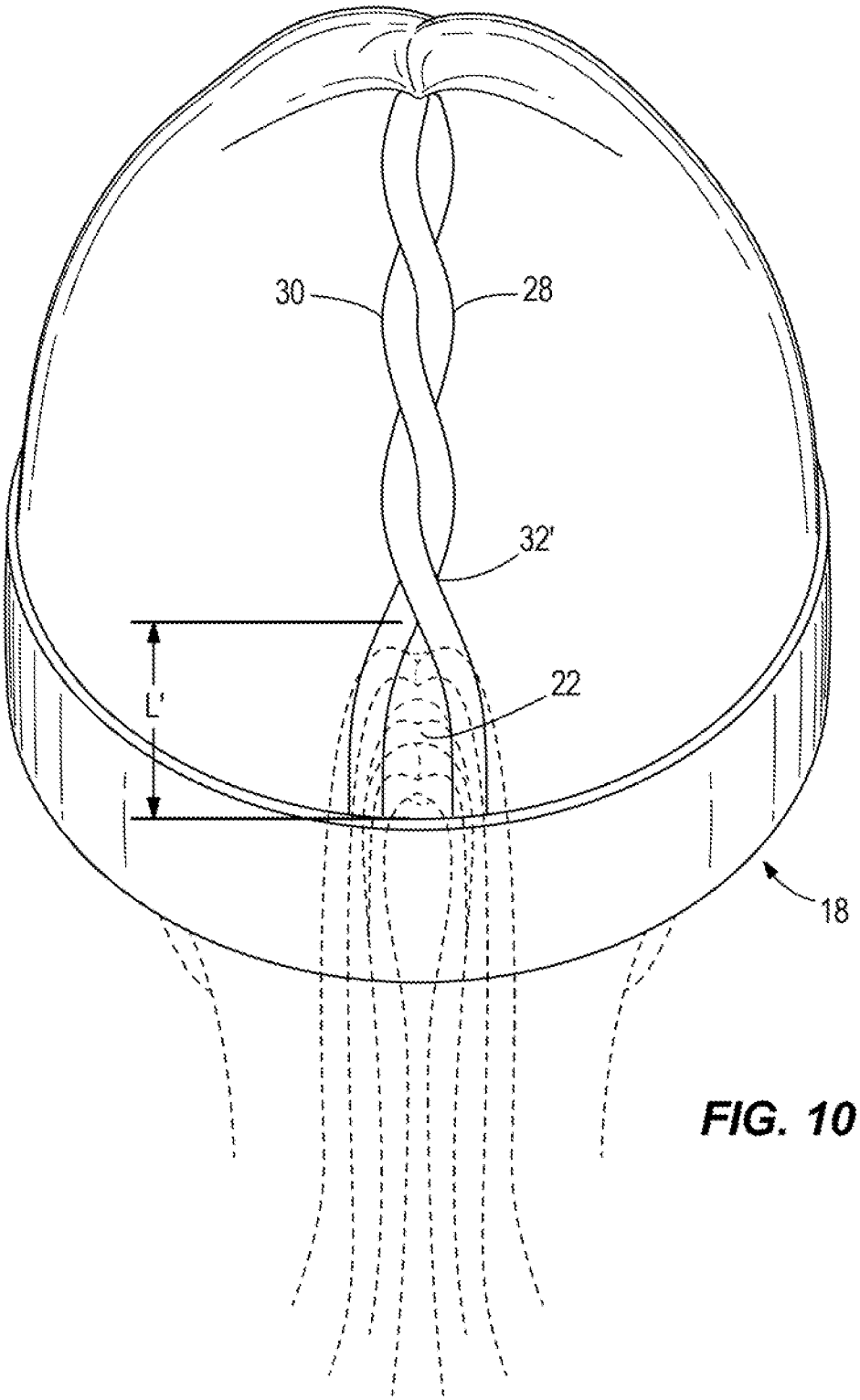
FIG. 10 illustrates another example of a stitched garment according to the present disclosure.

Further, the step shown at 110 (where one of the first 28 and second 30 strands is crossed over the other of the first 28 and second 30 strands) could be performed before, after, or both before and after the steps 106 and 108. For example, as shown in FIGS. 1 and 2, the first strand 28 is crossed over the second strand 30 and the first and second strands 28, 30 of the cable 16 are stitched together so as to form a turning row 32' before the first and second strands 28, 30 are stitched to the desired length L of the opening 22. The first strand 28 is also crossed over the second strand 30 after the first and second strands 28, 30 have been stitched to the desired length L of the opening 22, and the two strands 28, 30 are stitched together so as to form a turning row 32". In contrast, as shown in FIG. 10, the first strand 28 is stitched to a desired length L' of the opening 22 and the second strand 30 is stitched to the desired length L' of the opening 22 without the step 110 being performed beforehand. In other words, the first and second strands 28, 30 are not crossed prior to forming the opening 22. Rather, the first and second strands 28, 30 extend from the brim 18 of the hat 10 in a non-twisted fashion until the strands 28, 30 are crossed at the turning row 32'. To form the hat 10 of FIG. 10, the method includes stitching the first strand 28 to the desired length L' of the opening 22, stitching the second strand 30 to the desired length L' of the opening 22, and then crossing the first strand 28 over the second strand 30 and stitching together the first and second strands 28, 30 as they are crossed so as to form a turning row 32'. Therefore, the steps listed in the method of FIG. 9 need not be performed in the order shown therein.

With reference back to FIG. 4, a method for forming the turning row will be described. In the example shown, the background 12 is comprised of purl stitches and the cable 16 is comprised of knit stitches. It should be understood that the knit and purl could be reversed. Further, the background 12 could be comprised of any number of stitches, while the cable 16 could be comprised of any number of interlocking loops as well. For exemplary purposes, a cable 16 that comprises two knit stitches 42', 42" per row on a background of X purl stitches per row will be described. The opening 22 could be knit in the following manner:

Row 1: purl X, knit 4, purl X.

Row 2: knit X, purl 4, knit X.

Row 3: purl X, knit 4, purl X.

Row 4: knit X, purl 4, knit X.

Row 5: purl X, slip two stitches 42', 42" onto a cable needle 62 and hold the stitches 42', 42" for example in front of the background 12, knit 2 from a left hand needle (not shown), knit 2 from the cable needle 62, purl X.

Row 5 forms the turning row 32', wherein the first strand 28 is crossed over the second strand 30. It should be noted that either of the first strand 28 or the second strand 30 could be crossed over the other. Further, it should be noted that such crossing can occur in either a left-to-right or right-to-left direction. For example, in FIG. 4, the first strand 28 crosses in a left direction over the second strand 30. Meanwhile, a holding needle 44 is introduced to hold the second strand 30 of the cable 16 as the first strand 28 is knitted to the desired length L.

Continuing with row 6, the first strand 28 begins to be knitted to the desired length L of the opening 22. The first strand 28 is knit such that it is incorporated into the background 12. In the example shown, row 6 comprises the following stitches: knit X, purl 2.

As the first strand 28 continues to be knitted, row 7 comprises the following stitches: knit 2, purl X.

Row 8 of the first strand 28 then comprises the following stitches: knit X, purl 2.

Row 9 then repeats row 7, and row 10 repeats row 8. Rows 7 and 8 are repeated until the first strand 28 reaches the desired length L of the opening 22.

Figure 11:
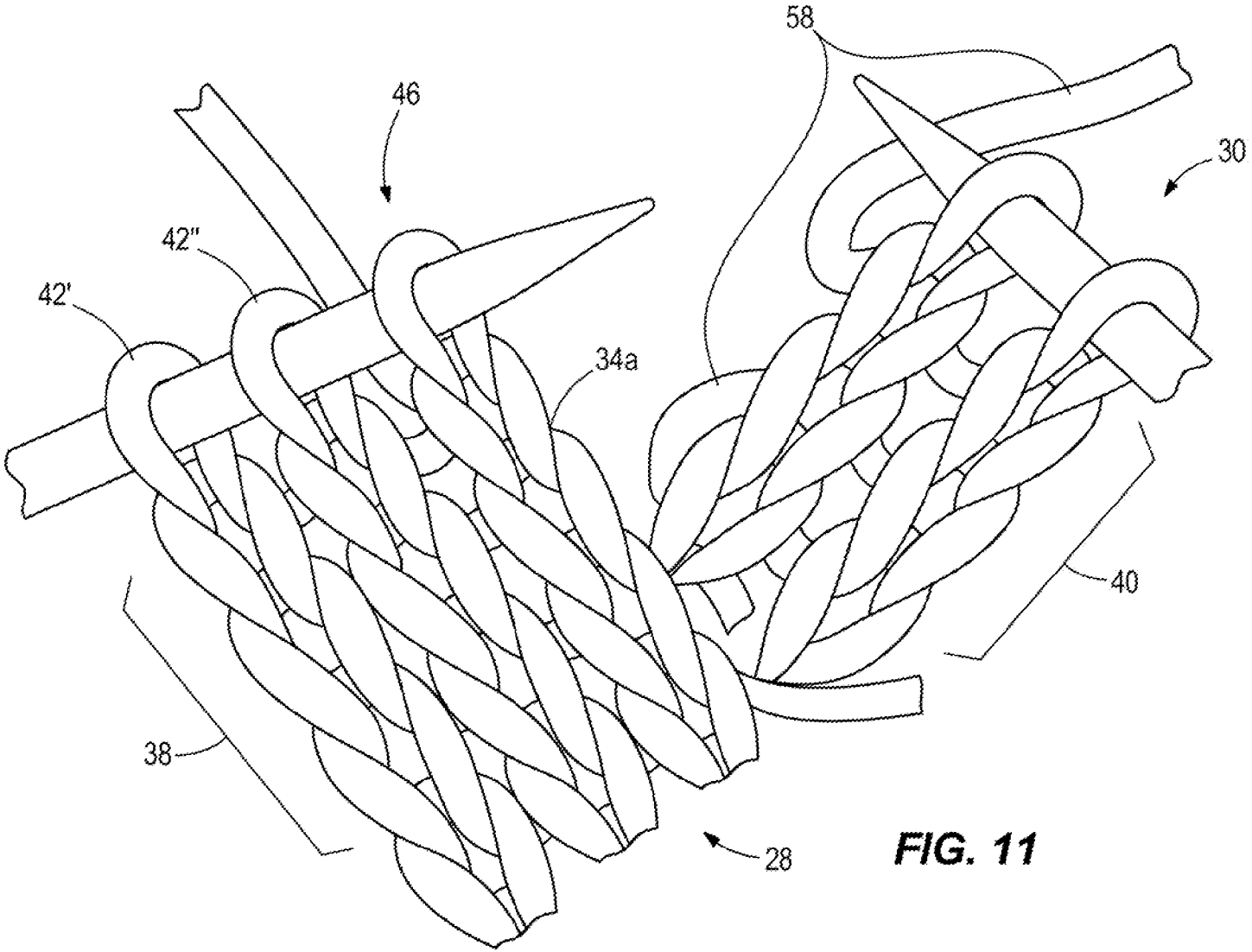
FIG. 11 illustrates a portion of another example of an opening in a stitched garment.

With reference to FIG. 11, the second strand 30 of the cable 16 is then knit to the desired length L of the opening 22. In one example, separate yarn 58 may need to be provided in order to do so. Separate yarn 58 may be incorporated by knitting in intarsia. Separate yarn 58 may not be required if knitting in the round. Whatever way the second strand 30 is knit, row 6 comprises the following stitches: purl 2, knit X.

Row 7: purl X, knit 2.

Row 8: purl 2, knit X.

Rows 7 and 8 are repeated until the desired length L of the opening 22 is reached. It is not necessary that the number of rows in each of the first and second strands 28, 30 along the opening 22 is the same.

Once the desired length L of the opening 22 has been reached, the next row can be a turning row, such as 32" in FIGS. 1 and 2. To form such turning row 32" the following stitches are made: knit X, slip next 2 stitches onto a cable needle and hold, for example, in front of the work piece, purl 2 from the left hand needle, purl 2 from the cable needle, knit X. The next row then comprises the following stitches: purl X, knit 4, purl X. In another example, a second opening 22 is formed immediately above the first opening 22 rather than knitting the first and second strands 28, 30 together in between the two openings.

Alternatively, if it is not desired that a turning row 32" be provided at the end of the pattern, the row immediately after the opening 22 comprises the following stitches: knit X, purl 4, knit X. If it is not desired to create another opening 22, the row beyond that comprises the following stitches: purl X, knit 4, purl X.

With reference to FIGS. 5 and 11, if it is desired to add extra interlocking loops 46 to the inner edge 34*a* of the first strand 28, Row 6 for example comprises the following stitches: knit X, purl 3. Row 7 comprises knit 3, purl X, and so on.

Figure 12:
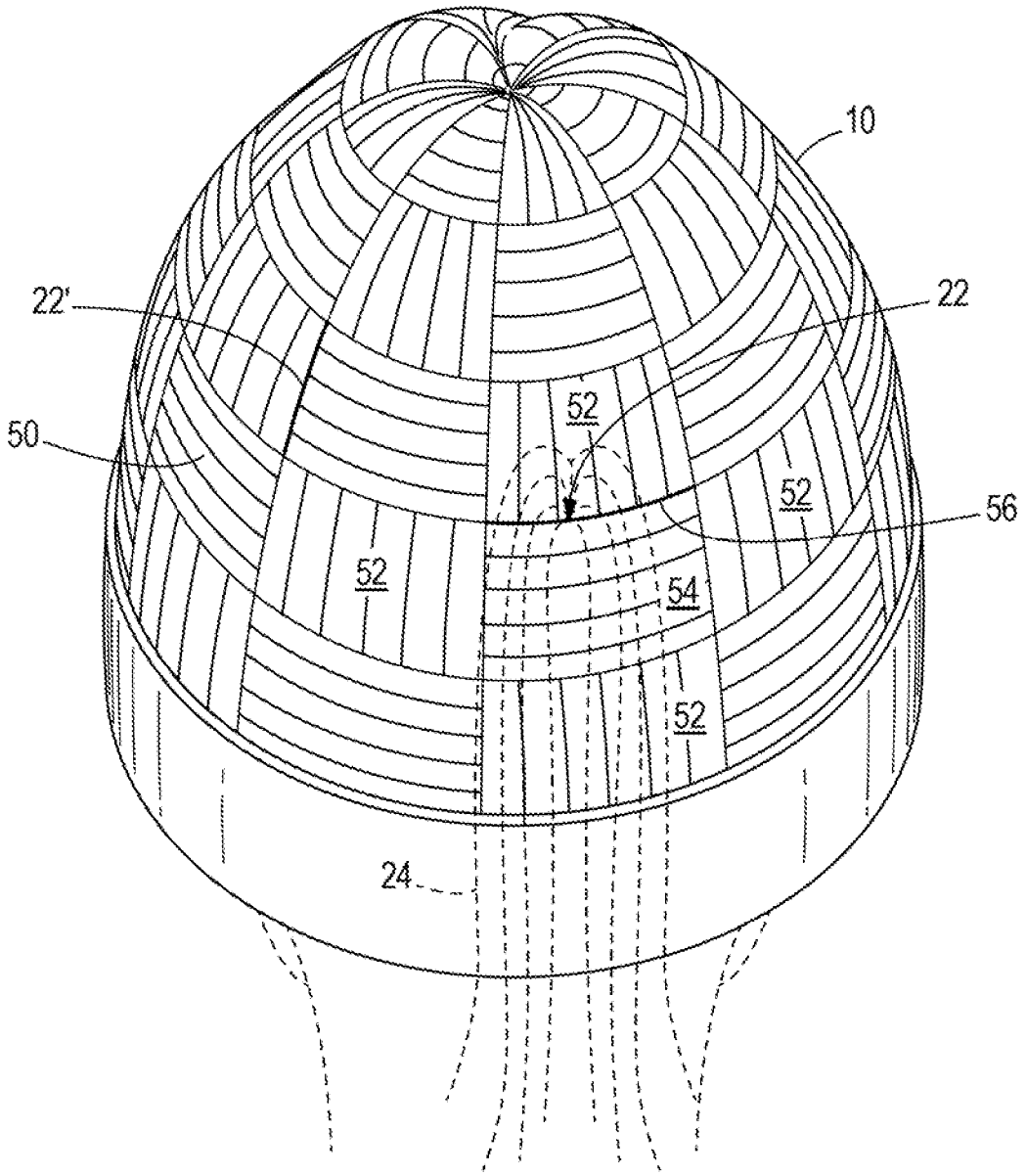
FIG. 12 illustrates another example of a stitched garment according to the present disclosure.
Figure 13:
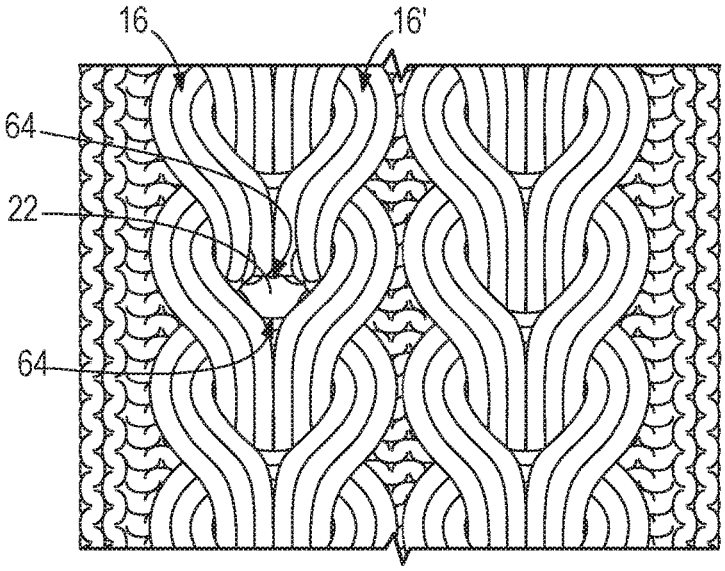
FIG. 13 illustrates one example of an arrow cable knit pattern on a garment.
Figure 14:
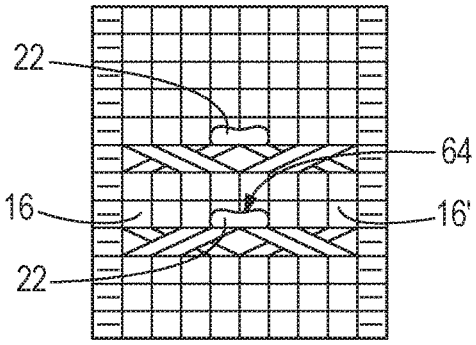
FIG. 14 illustrates one example of a knitting pattern for the arrow cable.
Figure 15:
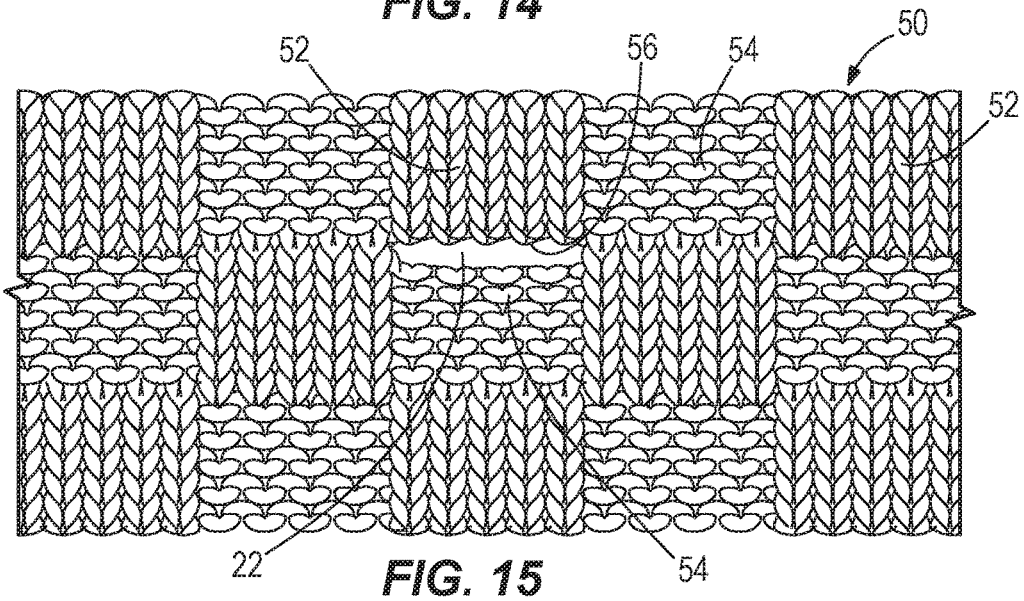
FIG. 15 illustrates one example of a basket weave knit pattern on a garment.

With reference to FIG. 12, the stitched pattern could also comprise a basket weave pattern 50 rather than a cable 16. Referring to both FIGS. 12 and 15, a basket weave pattern 50 comprises a plurality of rectangular checkers, for example alternating checkers of knit 52 and purl 54. The opening 22 could be provided along an edge 56 of a checker. At this edge 56, the knit checker 52 is not stitched to the purl checker 54. In one example, either the knit checker 52 or the purl checker 54 has extra interlocking loops added to it to create a flap that further hides the opening 22 from view. In another example, an opening 22' could be provided vertically between a knit checker 52 and a purl checker 54. The opening 22' could also be provided with a flap that further hides the opening 22' from view.

Therefore, with reference to each of the Figures, the present disclosure is of a main body of knit or crocheted yarn or strips of fabric; a pattern integrally formed with the knit or crocheted yarn or strips of fabric, the pattern comprising a first plurality of rows of interlocking loops 38 that crosses over a second plurality of rows of interlocking loops 40; and an opening 22 in the main body through which an article can be inserted. The opening 22 is integrated into the stitched pattern such that the opening 22 is hidden from view by the stitched pattern. In one example, the stitched pattern comprises a cable 16. The cable 16 comprises a first strand 28 having a first plurality of rows of interlocking loops 38 and a second strand 30 having a second plurality of rows of interlocking loops 40. The opening 22 is located between the first strand 28 and the second strand 30. In one example, the opening 22 is formed between the first plurality of rows of interlocking loops 38 in the pattern and the second plurality of rows of interlocking loops 40 in the pattern where the first plurality of rows of interlocking loops 38 in the pattern is adjacent to but is not stitched to the second plurality of rows of interlocking loops 40 in the pattern. The opening may be adjacent a location where the first plurality of rows of interlocking loops 38 is crossed over the second plurality of rows of interlocking loops 40.

The stitched garment may further comprise at least one turning row 32 where one of the first strand 28 and the second strand 30 is crossed over the other of the first strand 28 and the second strand 30, wherein the opening 22 is located between two turning rows 32', 32". The first strand 28 and the second strand 30 may each comprise inner edges 34*a*, 34*b* adjacent the opening 22 and outer edges 36*a*, 36*b* sewn to the background 12. In the turning row 32, the first plurality of rows of interlocking loops 38 stops at the inner edge 34*a* of the first strand 28 and the second plurality of rows of stitches 40 stops at the inner edge 34*b* of the second strand 30. As described herein above, this forces the opening 22 to stay more closed and hide the opening 22 from view.

The stitched garment may further comprise extra interlocking loops 46 added to at least the first plurality of rows of interlocking loops 38 at the inner edge 34*a* of the first strand 28 that fill the opening 22 and hide the opening 22 from view. Further, each of the first and second strands 28, 30 may comprise multiple interlocking loops 42', 42" and 42''', 42'''' in each of the first and second pluralities of rows of interlocking loops 38, 40 that add density to the first and second strands 28, 30 and hide the opening 22 from view. The stitched garment may further comprise at least a third strand 48 crossed with the first strand 28 and the second strand 30 that provides density to the cable 16 and hides the opening 22 from view.

In one example, the stitched pattern comprises a basket weave pattern 50 having a plurality of rectangular checkers 52, 54, wherein the opening 22 is located at an edge 56 of a checker.

In one example, the stitched garment comprises a knitted garment. In the example shown, the stitched garment comprises a ponytail hat 10 and the article comprises a wearer's hair 24. In another embodiment, the garment comprises scarf and the article comprises one end of the scarf.

Also disclosed is a method of making a ponytail hat. The method comprises stitching a plurality of rows of stitches to create a stitched background 12. The method further comprises stitching cable 16 into the stitched background 12 and stitching and opening 22 for a wearer's hair 24 into the cable 16. The opening 22 in integrated into the cable 16 such that the opening 22 is hidden from view. The method may further comprise stitching a first strand 28 of the cable 16 to a desired length L of the opening 22. The method may further comprise stitching a second strand 30 of the cable 16 to the desired length L of the opening 22. The method may further comprise crossing one of the first and second strands 28, 30 over the other of the first and second strands 28, 30 and stitching together the first and second strands 28, 30 of the cable 16 as they are crossed so as to form a turning row 32.

Forming the turning row 32 may further comprise partially stitching a row of interlocking loops up to the opening 22, crossing one of the first and second strands 28, 30 over the other of the first and second strands 28, 30, and thereafter stitching a remainder of the row of interlocking loops. The method may further comprise forming a turning row 32 immediately before and immediacy after stitching the opening 22, such as shown by turning rows 32', 32". The method may further comprise adding extra interlocking loops 46 to an edge 34*a* of at least the first strand 28 so as to hide the opening 22 from view. For example, as shown in FIG. 5, the extra interlocking loops 46 can be added to the inner edge 34*a* of the first strand 28. Or, as shown in FIG. 3, the extra interlocking loops can be added to the outer edges 36, 36' of the strands when the stitched pattern 14 comprises an arrow cable. The method may further comprise manipulating a gauge of stitches in the first strand 28 and the second strand 30 so as to create a bunching effect and hide the opening 22 from view. The method may further comprise knitting the plurality of rows of interlocking loops. The method may further comprise knitting the plurality of rows of interlocking loops in the round. The method may further comprise knitting the plurality of rows of interlocking loops by machine.

By integrating an opening 22 into the cable 16, it is possible to hide the opening 22 from view, thereby enhancing the aesthetics of the ponytail hat when no ponytail is inserted through the opening 22. Hiding the opening from view also prevents air from entering the hat 10 through the opening 22. Even if the opening 22 is not hidden from view, incorporating the opening 22 into a cable 16 enhances the aesthetics of the ponytail hat, as the opening 22 is part of a design rather than merely a large hole in the hat 10. Further, having an opening 22 that is hidden allows for multiple openings in the hat 10 without destroying the functionality of the hat 10 as a garment meant to keep a wearer's head warm. Having multiple openings 22 allows the wearer to choose the height of her ponytail, to wear pigtails, or to wear hair down (i.e., not in a ponytail). These multiple openings 22 can be provided to accommodate many hairstyles, yet will not be visible when the openings are not in use, and will not allow air to flow through when not in use.

The present disclosure contemplates creating such openings 22 with knitted or crocheted stitches that create cables 16 by twisting, weaving, drawing stitches over or under, and/or piercing other groups of stitches. The present application contemplates stitches made by hand, manual machine, semi-automatic machine, or automatic machine, as well as hats that are fully fashioned, cut and sewn, or made by complete garment knitting. The present application is applicable to both flat garments and seamless tubes.

In the above description certain terms have been used for brevity, clearness and understanding. No unnecessary limitations are to be implied therefrom beyond the requirement of the prior art because such terms are used for descriptive purposes only and are intended to be broadly construed. The different articles and methods described herein above may be used in alone or in combination with other articles and methods. Various equivalents, alternatives and modifications are possible within the scope of the appended claims. Each limitation in the appended claims is intended to invoke interpretation under 35 USC §112, sixth paragraph only the terms "means for" or "step for" are explicitly recited in the respective limitation. While each of the method claims includes a specific series of steps for accomplishing certain control system functions, the scope of this disclosure is not intended to be bound by the literal order or literal content of steps described herein, and non-substantial differences or changes still fall within the scope of the disclosure.

What is claimed is:

1. A garment comprising:

a main body of knit or crocheted yarn or strips of fabric;

a pattern integrally formed with the knit or crocheted yarn or strips of fabric, the pattern comprising a first plurality of rows of interlocking loops that crosses over a second plurality of rows of interlocking loops; and an opening in the main body through which an article can be inserted;

wherein the opening is formed between the first plurality of rows of interlocking loops in the pattern and the second plurality of rows of interlocking loops in the pattern where the first plurality of rows of interlocking loops in the pattern is adjacent to but is not stitched to the second plurality of rows of interlocking loops in the pattern and thereby integrated into the pattern such that the opening is hidden from view.

2. The garment of claim 1, wherein the opening is adjacent a location where the first plurality of rows of interlocking loops is crossed over the second plurality of rows of interlocking loops.

3. The garment of claim 2, wherein at the location where the first plurality of rows of interlocking loops is crossed over the second plurality of rows of interlocking loops, the first plurality of rows of interlocking loops stops at the opening and the second plurality of rows of interlocking loops stops at the opening.

4. The garment of claim 3, further comprising extra interlocking loops added to at least the first plurality of rows of interlocking loops adjacent the opening that fill the opening and hide the opening from view.

5. The garment of claim 1, wherein each of the first and second pluralities of rows of interlocking loops comprises multiple interlocking loops per row that add density to the first and second pluralities of rows of interlocking loops and hide the opening from view.

6. The garment of claim 1, further comprising at least a third plurality of rows of interlocking loops crossed with the first and second pluralities of rows of interlocking loops that provides density to the pattern and hides the opening from view.

7. The garment of claim 1, wherein the garment comprises a knitted headwear accessory.

8. The garment of claim 7, wherein the headwear accessory comprises a hat having a brim and a crown respectively defining a lower and an upper extent of the main body, the opening is located between the brim and the crown of the hat, and the article comprises a wearer's hair.

9. A garment comprising:

a main body of knit or crocheted yarn or strips of fabric;

a pattern integrally formed with the knit or crocheted yarn or strips of fabric, the pattern comprising a first plurality of rows of interlocking loops that crosses over a second plurality of rows of interlocking loops; and an opening in the main body through which an article can be inserted;

wherein the opening is formed between the first plurality of rows of interlocking loops in the pattern and the second plurality of rows of interlocking loops in the pattern where the first plurality of rows of interlocking loops in the pattern is adjacent to but is not stitched to the second plurality of rows of interlocking loops in the pattern and thereby integrated into the pattern such that the opening is hidden from view; and wherein the opening is adjacent a location where the first plurality of rows of interlocking loops is crossed over the second plurality of rows of interlocking loops.

10. The garment of claim 9, wherein at the location where the first plurality of rows of interlocking loops is crossed over the second plurality of rows of interlocking loops, the first plurality of rows of interlocking loops stops at the opening and the second plurality of rows of interlocking loops stops at the opening.

11. The garment of claim 10, further comprising extra interlocking loops added to at least the first plurality of rows of interlocking loops adjacent the opening that fill the opening and hide the opening from view.

12. The garment of claim 9, wherein each of the first and second pluralities of rows of interlocking loops comprises multiple interlocking loops per row that add density to the first and second pluralities of rows of interlocking loops and hide the opening from view.

13. The garment of claim 9, further comprising at least a third plurality of rows of interlocking loops crossed with the first and second pluralities of rows of interlocking loops that provides density to the pattern and hides the opening from view.

14. The garment of claim 9, wherein the opening is immediately adjacent the location where the first plurality of rows of interlocking loops is crossed over the second plurality of rows of interlocking loops.

15. The garment of claim 9, wherein the garment comprises a knitted headwear accessory.

16. The garment of claim 15, wherein the headwear accessory comprises a hat having a brim and a crown respectively defining a lower and an upper extent of the main body, the opening is located approximately halfway between the brim and the crown of the hat, and the article comprises a wearer's hair.

* * * * *